US005617786A

United States Patent [19]

Negishi

[11] Patent Number: 5,617,786

[45] Date of Patent: Apr. 8, 1997

[54] IMPROVED STENCIL PRINTING DRUM WHICH PREVENTS INK LEAKAGE

[75] Inventor: Hideo Negishi, Tokyo, Japan

[73] Assignee: Riso Kagaku Corporation, Tokyo, Japan

[21] Appl. No.: 510,570

[22] Filed: Aug. 2, 1995

[30] Foreign Application Priority Data

Aug. 2, 1994 [JP] Japan ..... 6-181566

[51] Int. Cl.[6] ..... B41L 13/06

[52] U.S. Cl. ..... 101/116; 101/120

[58] Field of Search ..... 101/116, 119, 101/120, 123, 124, 127, 127.1

[56] References Cited

U.S. PATENT DOCUMENTS

| | | | |
|---|---|---|---|
| 3,232,224 | 2/1966 | Kramer | 101/120 |
| 3,556,004 | 1/1971 | Mitter | 101/116 |
| 4,628,857 | 12/1986 | Coningsby | 101/120 |
| 5,090,312 | 2/1992 | Ohinata | 101/116 |

FOREIGN PATENT DOCUMENTS

| | | | |
|---|---|---|---|
| 89987 | 6/1982 | Japan | 101/119 |
| 165282 | 8/1985 | Japan | 101/120 |
| 4-331179 | 11/1992 | Japan . | |
| 2014905 | 9/1979 | United Kingdom . | |

*Primary Examiner*—Stephen R. Funk
*Attorney, Agent, or Firm*—Sughrue, Mion, Zinn, Macpeak & Seas

[57] ABSTRACT

A stencil printing drum comprises: a rotary cylindrical drum including an ink non-passage region, an ink passage region surrounded by the ink non-passage region, and an axis around which the rotary cylindrical drum rotates; an ink supplying roller whose axis of rotation is in parallel with the axis of the rotary cylindrical drum, the ink supplying roller being brought into contact with the inner cylindrical surface of the rotary cylindrical drum to push a printing ink out of the rotary cylindrical drum through the ink passage region; and an ink non-passage strip formed along the border between the ink non-passage region and the ink passage region except the start end portion thereof as viewed in the direction of rotation of the rotary cylindrical drum, in such a manner that the ink non-passage strip protrudes radially inwardly of the rotary cylindrical drum.

17 Claims, 8 Drawing Sheets

IMPROVED STENCIL PRINTING DRUM WHICH PREVENTS INK LEAKAGE

BACKGROUND OF THE INVENTION

1. Field of the Invention

This invention relates to a stencil printing drum, which is made up of a rotary cylindrical drum, in the printing section of a stencil printing machine.

2. Description of the Related Art

In general, a stencil printing operation is carried out with a stencil printing machine having a stencil printing drum. The stencil printing drum comprises: a rotary cylindrical drum having an ink passage region and an ink non-passage region; and an ink supplying roller provided inside the rotary cylindrical drum to supply a printing ink onto the inner cylindrical surface of the rotary cylindrical drum. With the machine, a stencil printing operation is carried out as follows: First, a stencil paper which has been perforated is wound on the outer cylindrical surface of the rotary cylindrical drum. Under this condition, a printing ink is supplied from the ink supplying roller provided inside the rotary cylindrical drum so as to be transferred through the stencil paper.

The rotary cylindrical drum is generally made up of a plurality of ink passage sheets laid one on another, and a stencil paper is placed over the outermost ink passage sheet. As is described above, the printing ink is supplied from the ink supplying roller provided inside the stencil printing drum. In this operation, the ink which is not used for printing, namely, an excess of ink may leak outside through the interface of the stencil paper and the ink passage sheet, or it may leak outside flowing through the interfaces of the plurality of ink passage sheets.

In order to overcome this difficulty, the following method has been proposed in the art: An ink bank for preventing the leakage of ink is provided in such a manner as to surround the ink passage region of the outer cylindrical surface of the stencil printing drum, or it is provided at the rear end of the ink passage region of the stencil printing drum as viewed in the direction of rotation of the stencil printing drum.

The above-described ink bank which surrounds the ink passage region of the outer cylindrical surface of the stencil printing drum or is provided at the rear end of the latter, is to stop the ink which otherwise may flow over the outer cylindrical surface of the rotary cylindrical drum. However, the quantity of ink which the ink bank is able to dam up is limited to a certain value. Hence, if the quantity of ink which leaks out is larger than the aforementioned value, then the ink will flow over the ink bank.

SUMMARY OF THE INVENTION

An object of the invention is to provide a stencil printing drum with which, in a printing operation, an excess of ink which has not been used is prevented from leaking outside the rotary cylindrical drum, being returned to the ink supplying roller, whereby the resultant print is high in quality.

In order to achieve the object, according to a first aspect of the present invention, there is provided a stencil printing drum comprising: a rotary cylindrical drum including an ink non-passage region, an ink passage region surrounded by the ink non-passage region, and an axis around which the rotary cylindrical drum rotates; an ink supplying roller whose axis of rotation is in parallel with the axis of the rotary cylindrical drum, the ink supplying roller being brought into contact with the inner cylindrical surface of the rotary cylindrical drum to push a printing ink out of the rotary cylindrical drum through the ink passage region; and an ink non-passage strip formed along the border between the ink non-passage region and the ink passage region except the start end portion thereof as viewed in the direction of rotation of the rotary cylindrical drum, in such a manner that the ink non-passage strip protrudes radially inwardly of the rotary cylindrical drum.

According to a second aspect, there is provided a stencil printing drum according to the first aspect, wherein the ink non-passage strip includes: an ink non-passage end strip formed along the border between the ink non-passage region and the finish end portion of the ink passage region as viewed in the direction of rotation of the rotary cylindrical drum, in such a manner that the ink non-passage end strip extends in parallel with the axis of the rotary cylindrical drum and protrudes radially inwardly of the rotary cylindrical drum.

According to a third aspect, there is provided a stencil printing drum according to the first aspect, wherein the ink non-passage strip includes: two ink non-passage side strips formed along the borders between the ink non-passage region and two opposite side portions of the ink passage region which are in parallel with the direction of rotation of the rotary cylindrical drum, in such a manner that the ink non-passage side strips protrude radially inwardly of the rotary cylindrical drum.

According to a fourth aspect, there is provided a stencil printing drum according to the third aspect, wherein the ink non-passage strip includes: an ink non-passage end strip formed along the border between the ink non-passage region and the finish end portion of the ink passage region as viewed in the direction of rotation of the rotary cylindrical drum, in such a manner that the ink non-passage end strip extends in parallel with the axis of the rotary cylindrical drum and protrudes radially inwardly of the rotary cylindrical drum.

According to a fifth aspect, there is provided a stencil printing drum according to the third aspect, wherein the ink supplying roller is arranged between the two ink non-passage side strips.

According to a sixth aspect, there is provided a stencil printing drum according to the third aspect, wherein the ink supply roller includes: a roller body which is brought into contact with the ink passage region; and two stepped portions smaller in diameter than the roller body, the stepped portions steps being brought into contact with the two ink non-passage side strips.

According to a seventh aspect, there is provided a stencil printing drum according to the sixth aspect, wherein a difference between the outside diameter of the roller body and the outside diameter of the stepped portions is substantially equal to the thickness of the ink non-passage side strips which protrudes radially inwardly of the rotary cylindrical drum.

According to an eighth aspect, there is provided a stencil printing drum according to the seventh aspect, further comprising: a pair of ink banks brought into contact with the cylindrical surfaces of the stepped portions, each of the ink banks having a sloped surface for leading the printing ink inwardly of the ink supplying roller which leaks over to the stepped portions.

According to a ninth aspect, there is provided a stencil printing drum as described above, wherein the ink supplying roller is made of an elastic material.

According to a tenth aspect, there is provided a stencil printing drum as described above, wherein a portion of the ink non-passage strip, the ink non-passage end strip, and the ink non-passage side strips which confronts with the ink passage region forms an angle with the ink passage region which is other than an obtuse angle.

DETAILED DESCRIPTION OF THE PREFERRED EMBODIMENTS

Preferred embodiments of the invention will be described with reference to the accompanying drawings.

Figure 1:
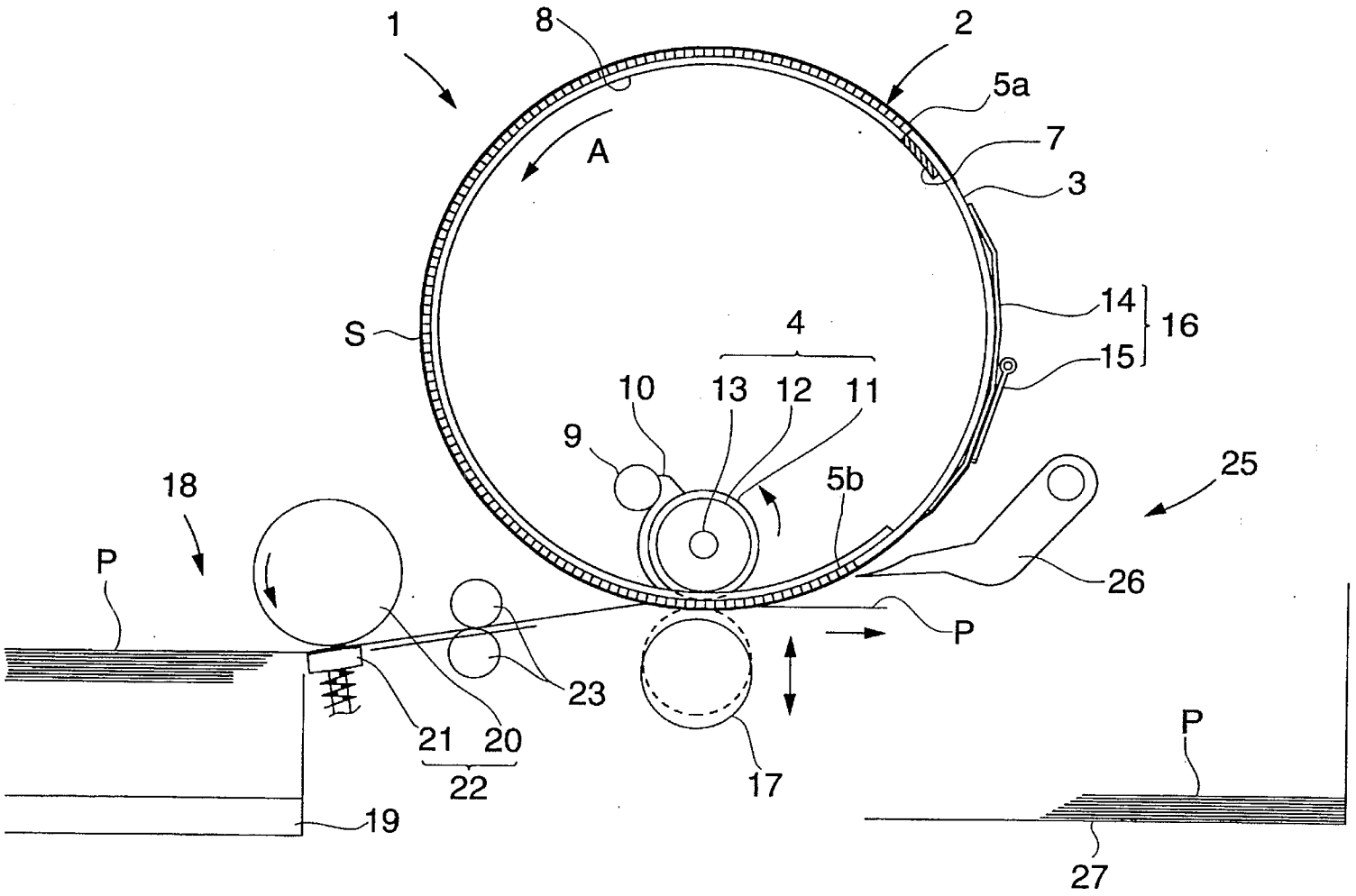
FIG. 1 is a sectional view showing the whole arrangement of a stencil printing machine according to a first embodiment of the invention.
Figure 2:
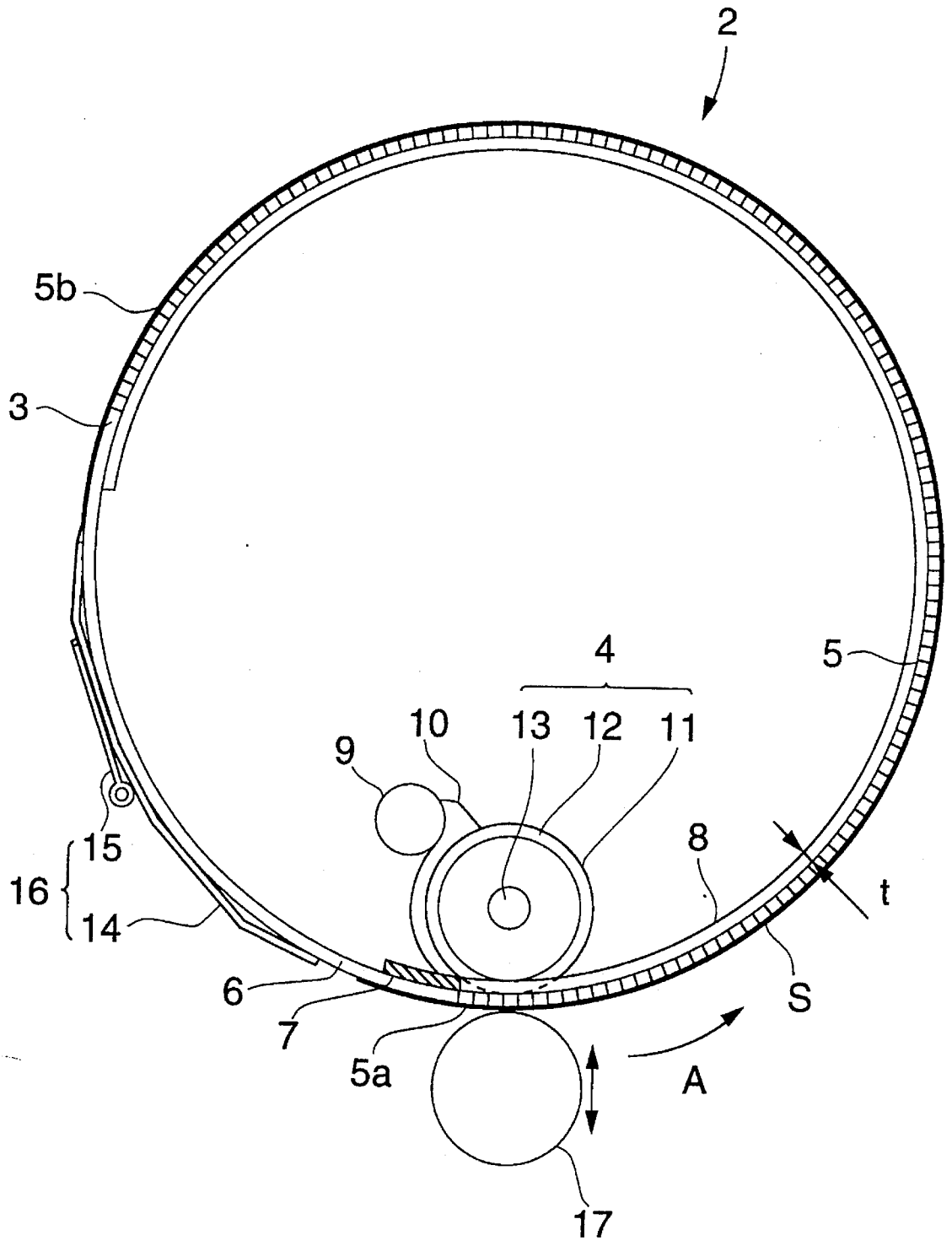
FIG. 2 is a sectional view showing essential components of a stencil printing drum applied to the stencil printing machine according to the first embodiment.
Figure 3:
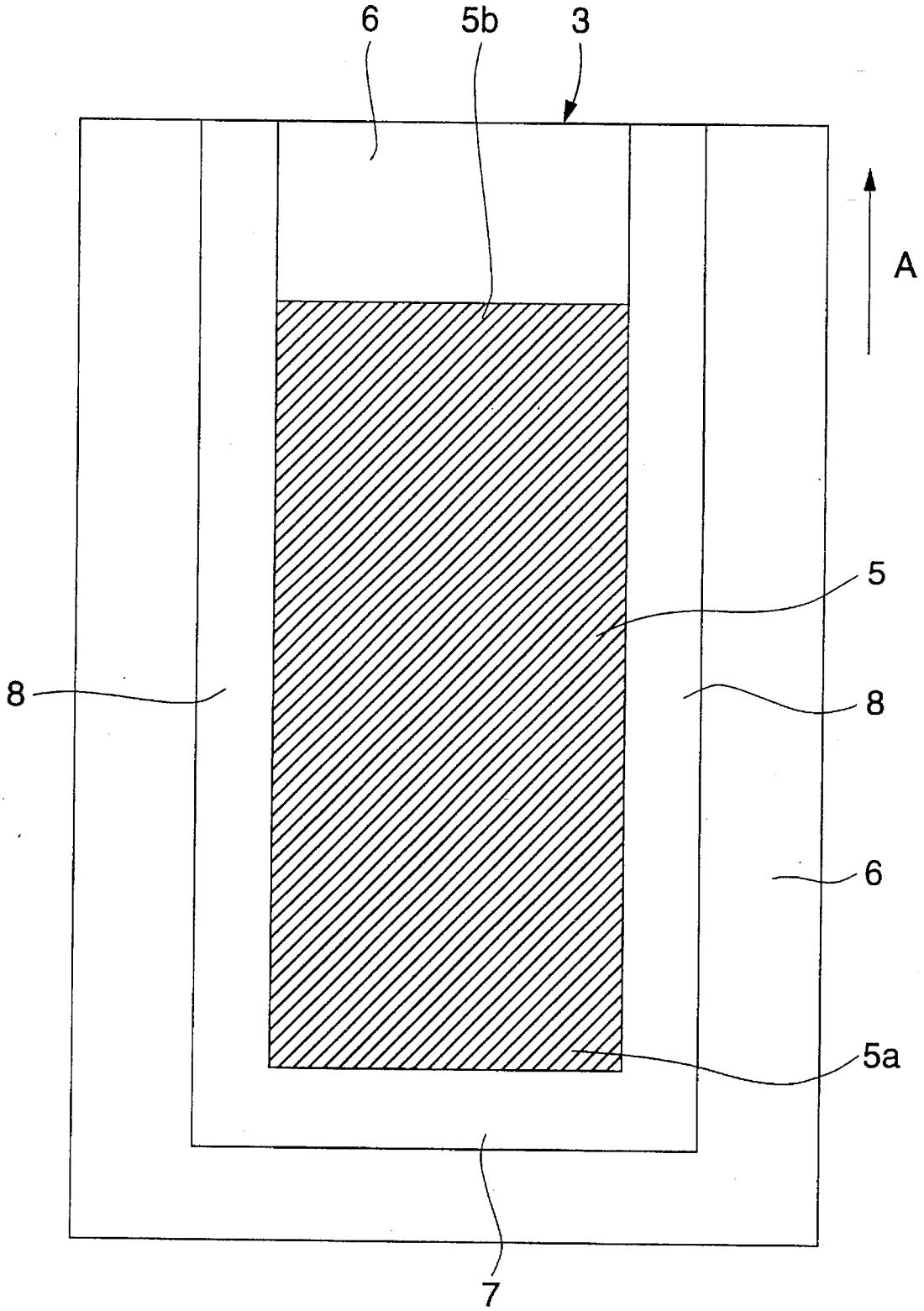
FIG. 3 is an unfolded view of a rotary cylindrical drum in the first embodiment.

FIG. 1 is a sectional view of a stencil printing machine 1 having a stencil printing drum, which constitutes a first embodiment of the invention. FIG. 2 is a sectional view of the stencil printing drum 2 in the printing machine 1. FIG. 3 is an unfolded diagram of a rotary cylindrical drum 3 of the stencil printing drum 2. FIG. 4 is a perspective view of an ink supplying roller 4 in the stencil printing drum 2 as viewing from inside thereof.

As shown in FIG. 1, the stencil printing machine 1 has the stencil printing drum 2 which is rotated around its central axis. The stencil printing drum 2 comprises: the rotary Cylindrical drum 3 which is rotated counter-clockwise in FIG. 1 or 2. As shown in FIG. 3, when unfolded the rotary cylindrical drum 3 is rectangular, and has a rectangular ink passage region 5 substantially at the center. The ink passage region 5 inside the rotary cylindrical drum 3 is surrounded by an ink non-passage region 6.

The rotary cylindrical drum 3 having the ink non-passage region 6 and the ink passage region 5 surrounded by the former 6 may be formed in various manners. For instance, it may be formed as follows: First, a cylinder is formed with a plurality of flexible ink passage screens which have been laid one on another. A pair of rigid disks are fixedly fitted in both ends of the cylinder, respectively. Thus, the rotary cylindrical drum 3 has been manufactured. In this manufacture process, blocking resin may be applied to a predetermined part of the screens, for instance, by printing, provided inside the rotary cylindrical drum 3 to define the ink passage region 5 and the ink non-passage region 6 therein.

Anther method of forming the drum 3 is as follows: A number of holes are formed in a predetermined region of a metal plate having a predetermined rigidity, for instance, by etching-or electrocasting, to change the region into an ink passage region 5. The metal plate thus processed is bent into a cylinder. Thus, the rotary cylindrical drum 3 has been formed. When necessary, the rotary cylindrical drum 3 may be constituted by the cylinder and an ink passage screen wound on the cylinder, so that the ink moved through the rotary cylindrical drum 3 onto a stencil paper wound on the outer cylindrical surface of the rotary cylindrical drum 3 is supplied to the printing sheet.

As shown in FIG. 3, an ink non-passage end strip 7 is formed, as a part of an ink non-passage strip, along the border line between the finish end portion 5*a* of the ink passage region 5 (as viewed in the direction of rotation A of the drum 3) and a part of the ink non-passage region 6 which is adjacent to and extends in parallel with the finish end portion 5*a*, in such a manner that the ink non-passage end strip 7 is substantially in parallel with the axis of rotation of the drum 3.

In addition, as shown in FIG. 3, two ink non-passage side strips 8 are formed along the border lines between the ink non-passage region 6 and both side portions of the ink passage region 5 which are in parallel with the direction of rotation A of the drum 3, in such a manner that the ink non-passage side strips 8 are in parallel with each other and are located on both sides of the ink passage region 5, respectively. Those side strips 8 extend until they have the part of the non-ink passage region 6 between them which is adjacent to the start end portion 5*b* of the ink passage region 5.

As shown in FIG. 2, the ink non-passage end strip 7 and the ink non-passage side strips 8 on the inner cylindrical surface of the drum 3 are radially inwardly of the rotary cylindrical drum 3 as much as a distance t; that is, they have a thickness of t. The parts of those strips 7 and 8 which are confronted with the ink passage region 5 form an angle with the ink passage region 5 which is other than an obtuse angle. In the embodiment, the angle is 90°. The ink non-passage end strip 7 and the ink non-passage side strips 8 may be formed, for instance, by printing them on the inner cylindrical surface of the drum 3 with a material such as silicon which is not affected by the ink. In this connection, it is preferable that the ink non-passage end strip 7 and the ink non-passage side strips 8 are elastic. In this embodiment, each of the ink non-passage end strip 7 and the ink non-passage side strips 8 is formed of the continuous plate in order to prevent the ink pass from passing therethrough.

The aforementioned ink supplying roller 4 is arranged inside the drum 3. The axis of rotation of the ink supplying roller 4 is in parallel with the axis of rotation of the drum 3. The ink supplying roller 4 is held in contact with the inner cylindrical surface of the drum 3 to push the ink out of the drum 3 through the ink passage region 50 The roller 4 is made of an elastic material. The axis of rotation of the roller 4 is fixed with respect to the inner cylindrical surface of the drum 3. An ink applying roller 9 is provided adjacent to the ink supplying roller 4. Ink supplying means (not shown) forms an ink pool 10 between the rollers 4 and 9. As the drum 3 is rotated, the ink supplying roller 4 is rotated, so that a layer of ink is formed on the surface of the ink supplying roller 4 to a predetermined thickness, and the ink is transferred onto the inner cylindrical surface of the drum 3.

Figure 4A:
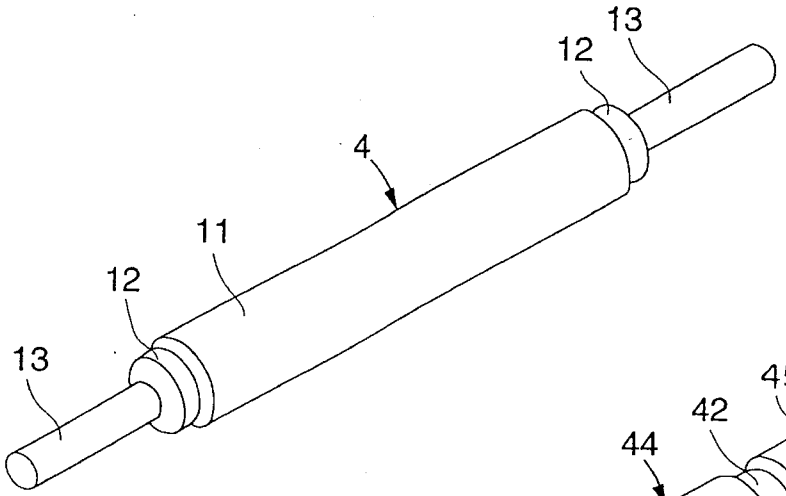
FIG. 4A is a perspective view of an ink supplying roller both in the first embodiment and in a second embodiment of the invention.

As shown in FIG. 4A, the ink supplying roller 4 comprises: a roller body 11 which is brought into contact with the ink passage region 5; a pair of stepped portions 12 and 12 provided at both ends of the roller body 11, respectively, those step portions 12 being smaller in outside diameter than the roller body 11; and a pair of shafts 13 and 13 which extend coaxially from the stepped portions 12 and 12, respectively.

The axial length of the roller body 11 is slightly shorter than the distance between the pair of ink non-passage side strips 8. A half of the difference between the outside diameter of the stepped portions 12 and that of the roller body 11 is equal to the thickness tof the ink non-passage end strip 7 and the ink non-passage side strips 8. Hence, when the roller body 11 is brought into contact with the ink passage region 5, the stepped portions 12 are pressingly brought into contact with the upper surfaces of the ink non-passage side strips 8.

As shown in FIGS. 1 and 2, a stencil paper clamping section 16 is provided on the part of the outer cylindrical surface of the rotary cylindrical drum 3 which corresponds to the ink non-passage region 6. The stencil paper clamping section 16 comprises: a stage member 14; and clamping means, namely, a clamp plate 15 which cooperates with the stage member 14 to lock one end of a stencil paper S. The clamp plate 15 is allowed to swing through about 180° on the stage member 14, to lock or unlock one end portion of a stencil paper S.

As shown in FIG. 1, a press roller 17 is provided below the drum 3 in such a manner that the press roller 17 is selectively movable in the vertical direction. When a printing sheet P is fed to the space between the press roller 17 and the drum 3 in synchronization with the rotation of the drum 3, the press roller 17 pushes the printing sheet P against the outer cylindrical surface of the drum 3, so that the printing ink supplied through the ink passage region of the drum 3 and the printing region of the stencil paper S is transferred onto the printing sheet P.

As shown in FIG. 1, a sheet supplying section 18 is provided on the left side of the stencil printing drum 2. The sheet supplying section 18 comprises: a sheet supplying tray 19 on which printing sheets P are stacked, the tray 19 being vertically moved by a stand vertically moving mechanism (not shown); conventional sheet supplying means 22 which includes a sheet supplying roller 20, and a sheet separating plate 21 with energizing means, to take the printing sheets P out of the sheet supplying tray 19 one by one; and a pair of sheet conveying rollers 23 for feeding a printing sheet P to the space between the drum 3 and the press roller 17 with predetermining timing.

As shown in FIG. 1, a sheet discharging section 25 is provided on the right side of the stencil printing drum 2. The sheet discharging section 25 comprises: a sheet separating claw 26 which is approached to the outer cylindrical surface of the stencil printing drum 2 in synchronization with the rotation of the stencil printing drum 2, to separate the printed sheet P from the rotary cylindrical drum 3; and a sheet discharging tray 27 on which a printed sheet P which has been separated from the drum 3 is placed.

With the stencil printing machine, a printing operation is carried out as follows: A perforated stencil paper S is wound on the rotary cylindrical drum 3, and its end portion is secured to the stage member 14 with the clamp plate 15, so that the printing region of the stencil paper S meets the ink passage region 5 of the drum 3. In synchronization with the rotation of the drum 3, a printing sheet P is supplied to the space between the drum and the press roller 17, and the roller 17 is moved upwardly so that the printing sheet P is held between the roller 17 and the drum 3. On the other hand, the ink supplying roller 4 provided inside the drum 3 supplies the printing ink to the inner cylindrical surface of the drum 3. The ink thus supplied is moved out through the ink passage region 5 of the drum 3 and the printing region of the stencil paper S, thus being transferred onto the printing sheet P which is held pushed against the outer cylindrical surface of the drum 3.

In the above-described printing operation, the ink which has not been used for printing although supplied to the inner cylindrical surface of the drum 3 is collected inside the ink non-passage end strip 7 as the ink supplying roller 4 and the drum 3 are rotated. As is described before, the angle formed between the inner end face of the ink non-passage end strip 7 and the ink passage region 5 is not an obtuse angle. Hence, with every printing operation; that is, whenever the ink supplying roller 4 moves over the ink non-passage end strip 7, the ink thus collected is adhered the cylindrical surface of the ink supplying roller 4. That is, the excess ink is not retained inside the ink non-passage end strip 7, and the difficulty associated with the ink being held and leaking out of the drum 3 is eliminated.

In the embodiment, the axial length of the roller body 11 is approximately equal to the distance between the pair of ink non-passage side strips 8. Hence, the ink remaining between the end faces of the roller body 11 and the inner end faces of the ink non-passage side strips 8 is returned inwardly as the ink supplying roller rotates. That is, an excess of ink is never held beside the ink non-passage side strips 8, and the difficulty is eliminated that the ink, being held, leaks out of the drum.

As is described above, in the embodiment, the ink supplying roller 4 is brought into contact with the inner cylindrical surface of the drum 3 by the press roller 17, and the roller 17 is moved vertically in synchronization with the supply of a printing sheet P so that the latter P is held between the press roller 17 and the drum 3. On the other hand, a stencil printing machine is known in the art in which, as disclosed by Japanese Patent Application No. 47029/1989 (filed with the Japanese Patent Office by the same applicant), the ink supplying roller is moved vertically inside the rotary cylindrical drum to radially outwardly push the cylindrical wall of the drum to hold a printing sheet between the press roller and the drum. In a stencil printing machine of this type, too, the ink non-passage end strip and the ink non-passage side strips in the embodiment of the invention may be applied to the stencil printing drum. In this case, in order to prevent from leaking the ink outward from both sides of the rotary cylindrical drum, it is preferable that the thickness of the ink non-passage end strip 7 and the ink non-passage side strips 8 formed on the inner cylindrical surface of the rotary cylindrical drum is equal to or more than the amount of protrusion which is given to the cylindrical wall of the drum by the ink supplying roller.

Figure 5:
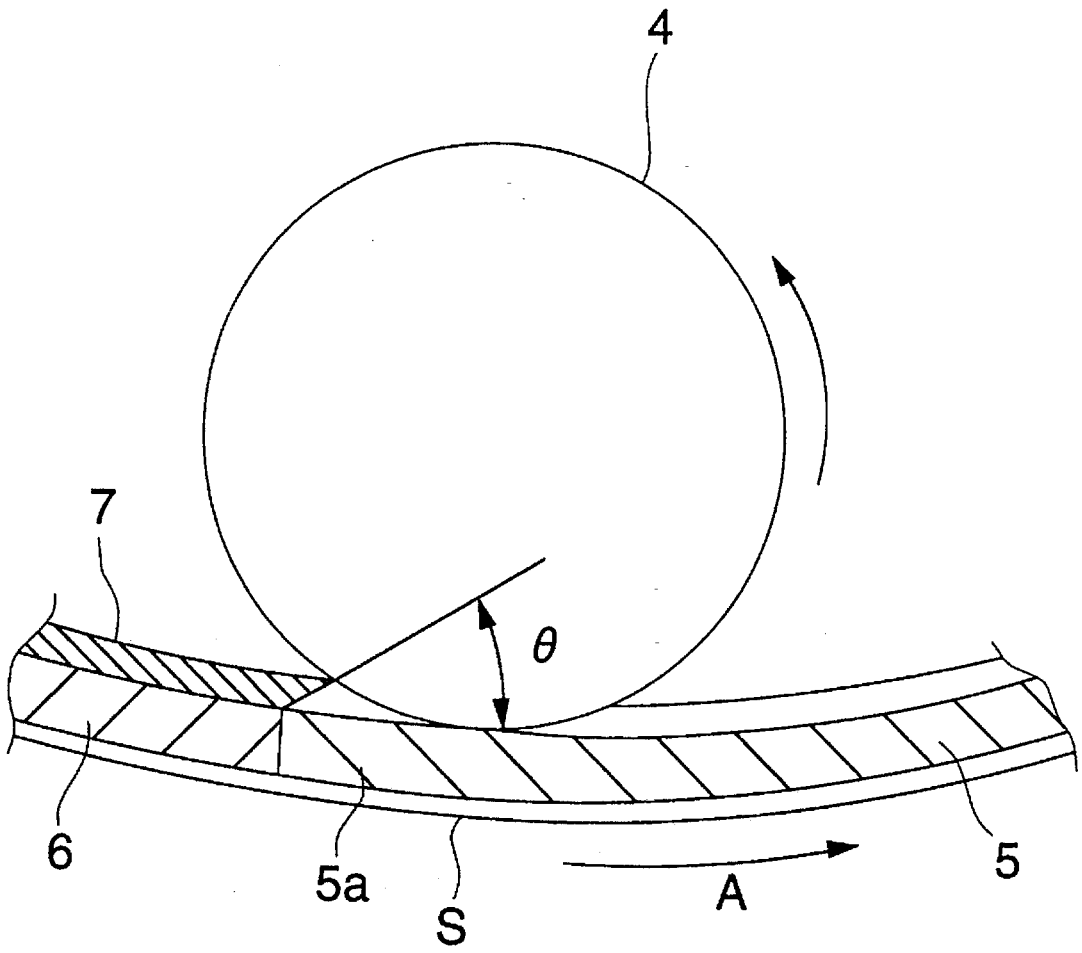
FIG. 5 is an enlarged sectional view for a description of the contact of the rotary cylindrical drum with the ink supplying roller in each of the embodiments of the invention.

In the above-described embodiment, the angle formed between the ink passage region 5 and the inner end face of the ink non-passage end strip 7 is 90°, other than an obtuse angle; however, the invention is not limited thereto or thereby. That is, the angle may be set to a value smaller than 90° as shown in FIG. 5. In this case, it is more difficult for the ink to move over the ink non-passage end strip 7; that is, the leakage of ink can be more positively prevented.

Now, another example of the stencil printing drum, which constitutes a second embodiment of the invention, will be described. The second embodiment is obtained by coupling ink banks 30 shown in FIG. 8 to the ink supplying roller 4 in the stencil printing drum 2 according to the first embodiment. In the second embodiment, the other arrangements are equal to those of the first embodiment, and parts corresponding functionally to those already described with reference to the first embodiment are therefore similarly designated.

Figure 6:
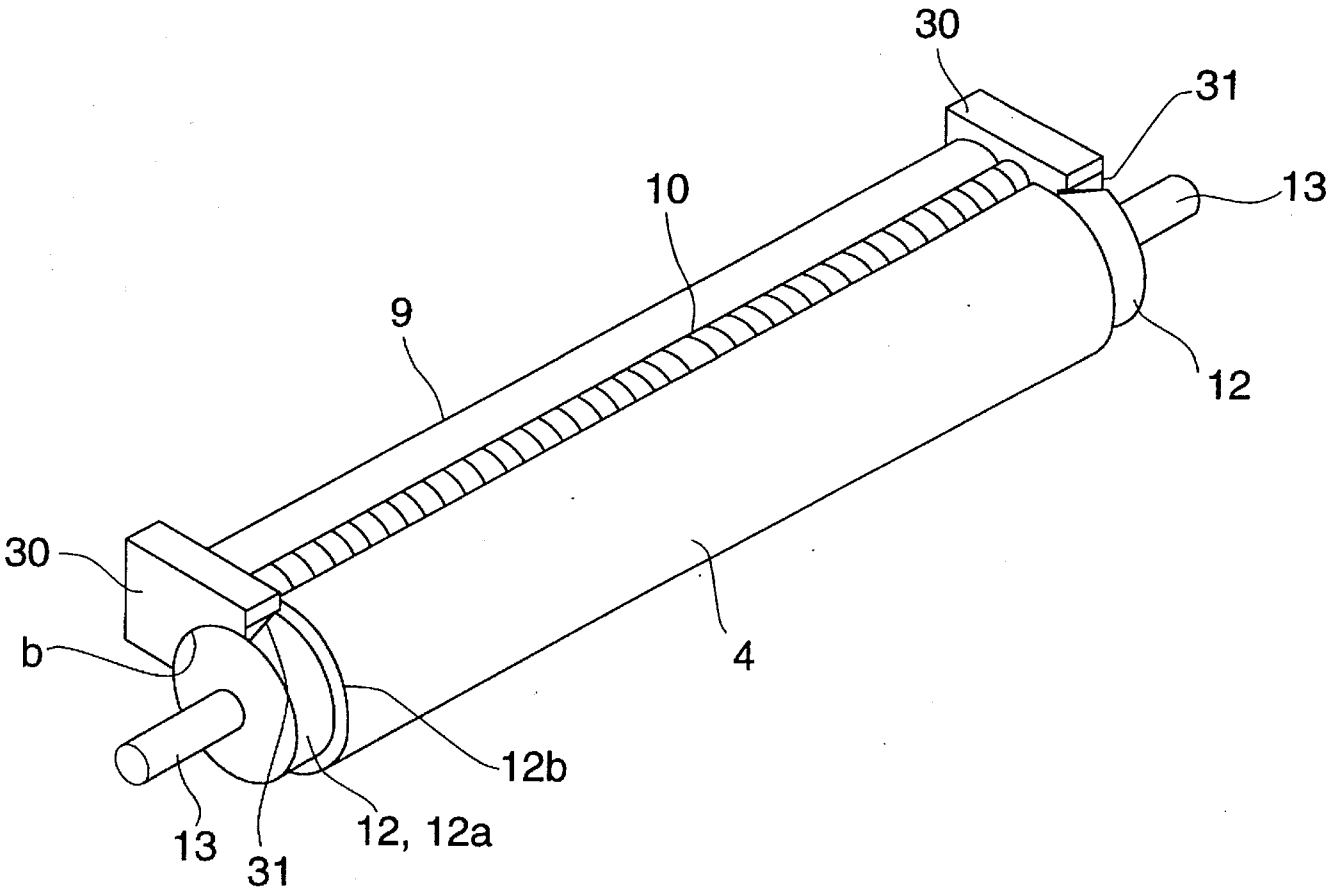
FIG. 6 is a perspective view of the ink supplying section in the second embodiment of the invention.
Figure 7:
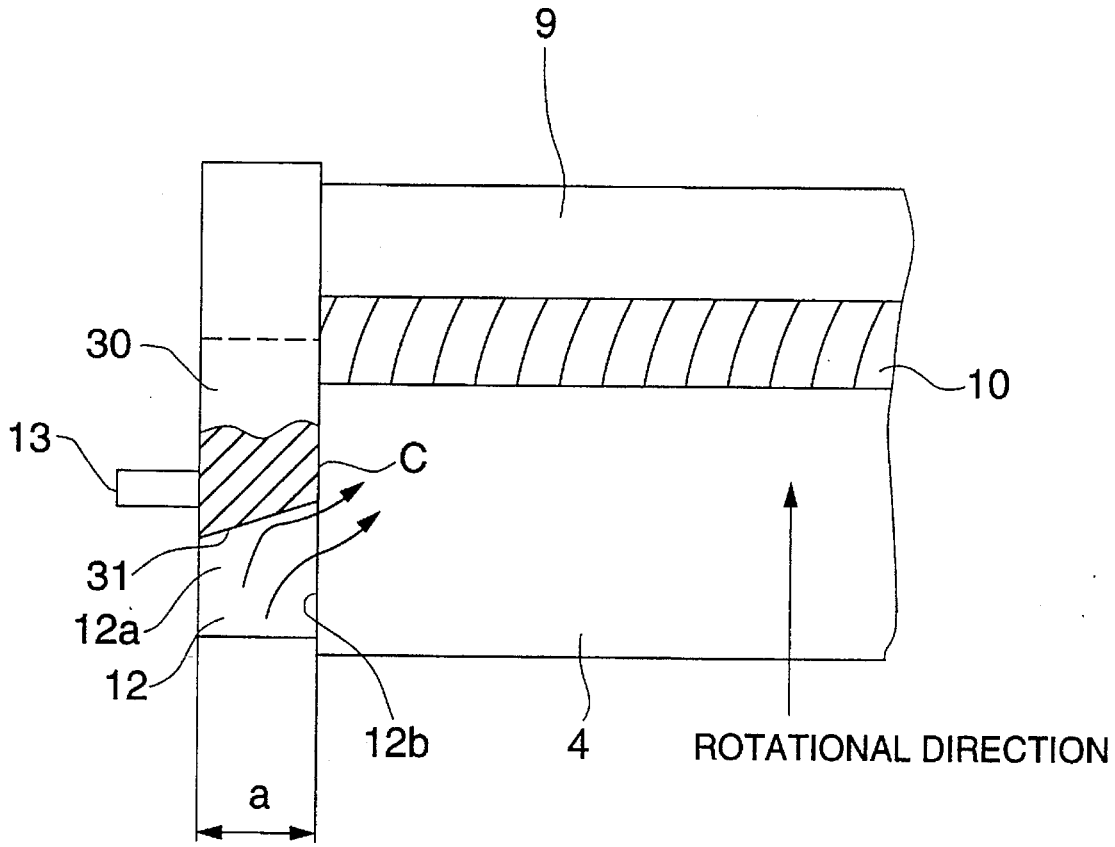
FIG. 7 is a fragmental view showing essential components of the ink supplying section in the second embodiment of the invention.
Figure 8:
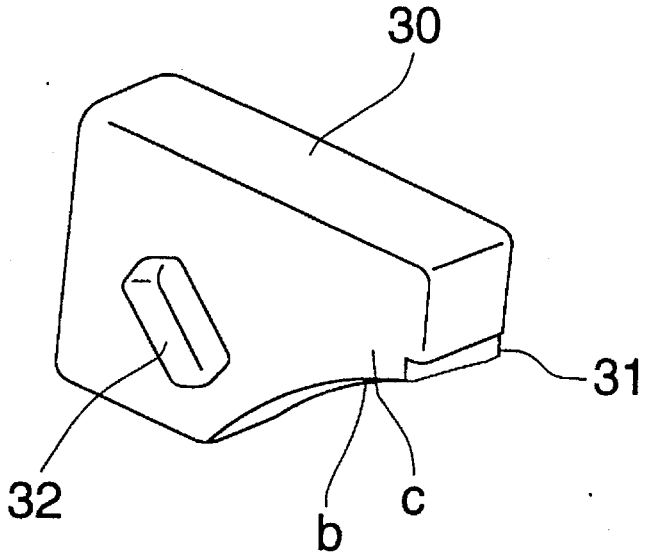
FIG. 8 is a perspective view of an ink bank employed in the second embodiment and in the third embodiment of the invention.

As shown in FIGS. 6 and 7, a pair of ink banks 30 are provided at both ends of the ink supplying roller 4 in such a manner as to embrace the ink pool 10 formed between the ink applying roller 9 and the ink supplying roller 4. As shown in FIGS. 6 through 8, each of the ink banks 30 is substantially in the form of a rectangular parallelepiped whose one corner is cut to have a guide surface b which is inwardly curved. The guide surfaces b of the ink banks 30 are brought into contact with the cylindrical surfaces 12*a* of the stepped portions 12 from above, respectively. The inner surfaces c of the pair of ink banks 30 are in contact with the annular end faces 12*b* which are located beside the stepped portions 12, respectively.

In each of the ink banks 30, the upper end portion of the guide surface b is formed into a sloped surface 31 so that the ink leaked over to the stepped portion 12 is led into the ink pool 10 The sloped surface 31, as shown in FIG. 7, is larger in depth towards the center of the ink supplying roller 4 as viewed in the direction of rotation of the latter 4 (indicated by the straight arrow in FIG. 7). More specifically, the sloped surface 31 extends over the annular end face 12*b* and above the outer cylindrical surface of the ink supplying roller 4.

Hence, even if the ink leaks onto the stepped portions 12, it is caught by the sloped surfaces 31 of the ink banks 30 as the ink supplying roller 4 turns. The ink thus caught is returned towards the body of the ink supplying roller 4 while being guided by the sloped surfaces 31.

In order to adjust the gap between the ink supplying roller 4 and the ink applying roller 9, the ink banks 30 have a pair of elongated grooves 32, respectively, with which both ends of the ink applying roller 9 are movably engaged. Hence, the distance (or gap) between the ink supplying roller 4 and the ink applying roller 9 can be set to a desired value by moving the ink applying roller 9 along the elongated grooves 32 of the ink banks 30.

When, in FIG. 1, the stencil printing drum 2 is turned counterclockwise, the ink supplying roller 4 is also turned counterclockwise. The ink supplying means (not shown) supplies a printing ink to form the above-described ink pool 10 in the wedge-shaped space between the ink applying roller 9 and the ink supplying roller 4. As the printing operation starts, the ink in the ink pool 10 is caused to whirl in a direction perpendicular to the longitudinal direction of the latter 10, and the ink whirling in this manner is applied to the ink supplying roller 4 by the ink applying roller 9. The ink applied to the ink supplying roller 4 is supplied to the inner cylindrical surface of the drum 3.

The side walls of the ink banks 30 prevent the ink in the ink pool 10 from spreading sidewards. The guide surfaces b of the ink banks 30 are in contact with the stepped portion cylindrical surfaces 12*a* of the stepped portions 12, and the ink leaked onto the stepped portions steps 12 of the ink supplying roller 4 is returned into the ink pool 10 by the sloped surfaces 31 of the ink banks 30 which are in contact with the annular end faces 12*b* of the stepped portions 12. Hence, the ink will never leak out of the ink supplying range of the ink supplying ink 4; that is, the leakage of the ink is positively limited. That is, the stencil printing drum of the invention is completely free from the difficulty that the printing machine or the printing sheet P is stained with the printing ink.

Similarly as in the case of the first embodiment, an excess of ink held between both end faces of the roller body 11 and the inner end faces of the ink non-passage side strips 8 is returned inwardly as the ink supplying roller 4 rotates. Hence, the excess of ink will never leak over the ink non-passage side strips 8. Even if the ink collected at the inner end faces of the ink non-passage side strips 8 is moved over the latter 8, it is stuck onto the stepped portion 12 of the ink supplying roller 4, thus being transferred to the ink banks 30. That is, similarly as in the above-described case, it is returned inwardly of the ink supplying roller 4.

In the printing operation, the printing ink may be partially collected inside the ink non-passage end strip 7, thus not being used for printing. The ink thus collected, similarly as in the case of the first embodiment, is moved away being adhered to the cylindrical surface of the ink supplying roller 4 every printing operation; i.e., whenever the latter 4 is moved over the ink non-passage end strip 7. Hence, no excess of ink is collected on the inside surface the ink non-passage end strip 7; that is, the stencil printing drum is free from the difficulty that the ink, being held, leaks out of the drum 3.

Now, another example of the stencil printing drum, which constitutes a third embodiment of the invention, will be described.

Figure 4B:
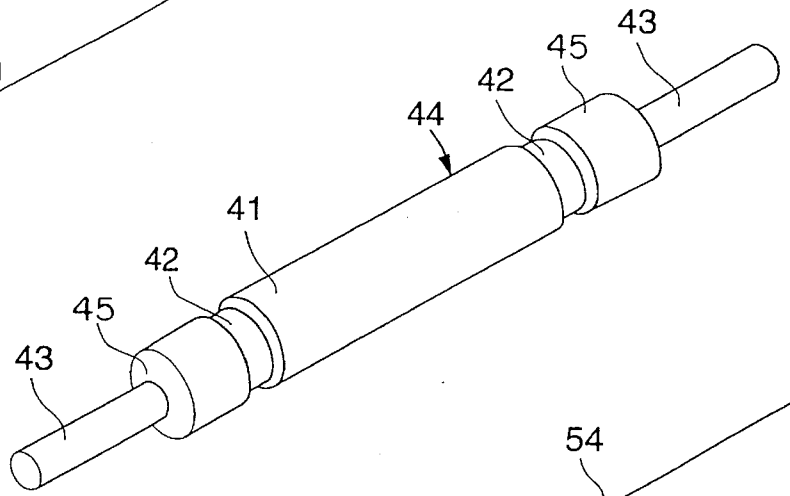
FIG. 4B is a perspective view of an ink supplying roller in a third embodiment of the invention.

In the third embodiment, its ink supplying roller is different in structure from those of the above-described first and second embodiments. The remaining components of the third embodiment is equal in structure to those of the second embodiment. The ink supplying roller 44 of the third embodiment, as shown in FIG. 4B, comprises: a roller body 41 which is brought into contact with the ink passage region 5; a pair of stepped portions 42 extended coaxially from both ends of the roller body 41, the stepped portions 42 being smaller in outside diameter than the roller body 41; a pair of supporting rollers 45 which extend coaxially from the stepped portions 42, respectively, the supporting rollers 45 being equal in outside diameter to the roller body 41; and a pair of shafts 43 which are extended coaxially from the supporting roller 45, respectively.

The axial length of the roller body 41 is substantially equal to the distance between the ink non-passage side strips 8. A half of the difference between the outside diameters of the stepped portions 42 and the roller body 41 is equal to the thickness t of the ink non-passage end strip 7 and the ink non-passage side strips 8. The width of each of the stepped portions 42 is substantially equal to the width of the ink non-passage side strips 8. Hence, the ink supplying roller 44 is brought into contact with the rotary cylindrical drum 3 in the following manner: The roller body 41 is in contact with the ink passage region 5, the stepped portions 42 are in contact with the upper surfaces of the ink non-passage side strips 8, respectively, and the supporting rollers 45 are in contact with the ink non-passage region 6 which is located outside the ink non-passage side strips 8. The end faces of the roller body 41 and the supporting rollers 45 are in contact with the inside and outside end faces of the ink non-passage side strips 8. A pair of ink banks (not shown in FIG. 4B) similar to those of the second embodiment are provided at the stepped portions 42 of the ink supplying roller 44.

The third embodiment has the same effects as the second embodiment. In the third embodiment, the length of contact of the ink supplying roller 44 with the inner cylindrical surface of the rotary cylindrical drum 3 is longer than in the second embodiment, and the ink supplying roller 44 is in contact with the inner cylindrical surface of the drum 3 substantially over its whole length as viewed in the direction of axis of the drum 3. Therefore, the ink supplying roller 44 is uniformly brought into contact with the drum 3; that is, the drum 3 is scarcely deformed by the roller 44 although being pushed by the roller 44. Hence, the stencil printing drum according to the third embodiment is applicable especially to a stencil printing machine of the type that a vertically movable ink supplying roller pushes the rotary cylindrical drum from inside to deform the rotary cylindrical drum.

Another example of the stencil printing drum, which constitutes a fourth embodiment of the invention, will be described.

Figure 4C:
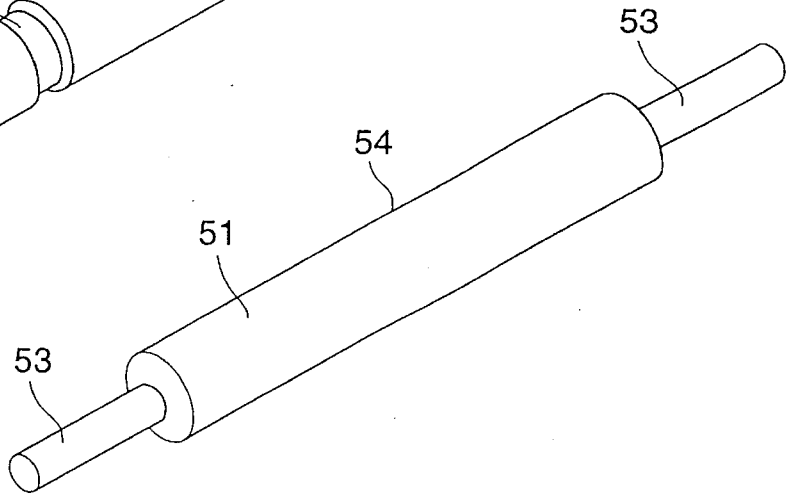
FIG. 4C is a perspective view of an ink supplying roller in a fourth embodiment of the invention.

In the fourth embodiment, its ink supplying roller is different in structure from those of the above-described first through third embodiments, and has no ink banks (30). The remaining components of the fourth embodiment has similar structures to those of the first embodiment. The ink supplying roller 54 of the fourth embodiment, as shown in FIG. 4C, comprises: a roller body 51; and a pair of shafts 53 extending from both ends of the roller body 51. The axial length of the roller body 51 is substantially equal to the distance between the pair of ink non-passage side strips 8. The roller body 51 is placed between those side strips 8 in such a manner that it is in contact with the ink passage region 5.

Similarly as in the case of the first embodiment, an excess of ink held between the end faces of the roller body 51 and the inner end faces of the ink non-passage side strips 8 is returned inwardly as the ink supplying roller 54 turns. Hence, the excess of ink will never flow over the ink non-passage side strips 8.

In the printing operation, the printing ink may be partially collected inside the ink non-passage end strip 7, not being used for printing. The ink thus collected, similarly as in the case of the first embodiment, is moved away being adhered to the cylindrical surface of the ink supplying roller 54 when the latter 54 is moved over the ink non-passage end strip 7 in every printing operation. Hence, no excess of ink is collected inside the ink non-passage end strip 7; that is, the stencil printing drum is free from the difficulty that the ink, being held, leaks out of the drum 3.

In the above described embodiments, in order to prevent the ink leaking out of the drum, the ink non-passage strip is provided. If the ink supplying roller is formed as shown in FIG. 4A or 4C, the ink non-passage region 6 per se may protrude radially inwardly instead of the ink non-passage strip.

In the stencil printing drum according to the invention, the ink non-passage strip is formed along the border between the ink non-passage region and the ink passage region in such a manner that it protrudes radially inwardly of the rotary cylindrical drum. Hence, an excess of ink which is collected at the ink non-passage strip in a printing operation, is removed being stuck onto the ink supplying roller which is held in contact with the ink passage region of the rotary cylindrical drum. That is, the excess of ink which is not used for printing is returned to the ink supplying roller without leaking out of the rotary cylindrical drum. Hence, the resultant print is high in quality.

What is claimed is:

1. A stencil printing drum comprising:

a rotary cylindrical drum including an ink non-passage region, an ink passage region surrounded by said ink non-passage region, and an axis around which said rotary cylindrical drum rotates, said ink passage region including a start end portion at one end thereof and a finish end portion at an opposite end thereof as viewed in the direction of said rotation;

an ink supply roller having an axis of rotation which is in parallel with said axis of said rotary cylindrical drum, said ink supplying roller being brought into contact with an inner cylindrical surface of said rotary cylindrical drum to push a printing ink out of said rotary cylindrical drum through said ink passage region; and an ink non-passage strip formed along the border between said ink non-passage region and said ink passage region except the start end portion thereof, in such a manner that said ink non-passage strip protrudes radially inwardly of said rotary cylindrical drum.

2. A stencil printing drum according to claim 1, wherein said ink non-passage strip includes:

an ink non-passage end strip formed along the border between said ink non-passage region and the finish end portion of said ink passage region as viewed in the direction of rotation of said rotary cylindrical drum, in such a manner that said ink non-passage end strip extends in parallel with said axis of said rotary cylindrical drum and protrudes radially inwardly of said rotary cylindrical drum.

3. A stencil printing drum according to claim 1, wherein said ink non-passage strip includes:

two ink non-passage side strips formed along the borders between said ink non-passage region and two opposite side portions of said ink passage region which are in parallel with the direction of rotation of said rotary cylindrical drum, in such a manner that said ink non-passage side strips protrude radially inwardly of said rotary cylindrical drum.

4. A stencil printing drum according to claim 3, wherein said ink non-passage strip includes:

an ink non-passage end strip formed along the border between said ink non-passage region and the finish end portion of said ink passage region as viewed in the direction of rotation of said rotary cylindrical drum, in such a manner that said ink non-passage end strip extends in parallel with said axis of said rotary cylindrical drum and protrudes radially inwardly of said rotary cylindrical drum.

5. A stencil printing drum according to claim 3, wherein said ink supplying roller is arranged between said two ink non-passage side strips.

6. A stencil printing drum according to claim 3, wherein said ink supply roller includes:

a roller body which is brought into contact with said ink passage region; and a pair of stepped portions having a diameter which is smaller than said roller body, said stepped portions being brought into contact with said two ink non-passage side strips.

7. A stencil printing drum according to claim 6, wherein a difference between the outside diameter of said roller body and the outside diameter of said stepped portions is substantially equal to twice the thickness of said ink non-passage side strips which protrude radially inwardly of said rotary cylindrical drum.

8. A stencil printing drum according to claim 7, further comprising:

a pair of ink banks brought into contact with the cylindrical surfaces of said stepped portions, each of said ink banks having a sloped surface for leading the printing ink inwardly of said ink supplying roller which leaks over to said stepped portions.

9. A stencil printing drum as claimed in any one of the preceding claims, wherein said ink supplying roller is made of an elastic material.

10. A stencil printing drum according to claim 2, wherein a portion of said ink non-passage end strip which confronts with said ink passage region forms an angle with said ink passage region which is other than an obtuse angle.

11. A stencil printing drum according to claim 2, wherein said ink non-passage end strip is formed of a continuous plate.

12. A stencil printing drum according to claim 3, wherein a portion of each of said ink non-passage side strips which confronts with said ink passage region forms an angle with said ink passage region which is other than an obtuse angle.

13. A stencil printing drum according to claim 3, wherein said ink non-passage side strips are made of an elastic material.

14. A stencil printing drum according to claim 3, wherein each of said ink non-passage side strips is formed of a continuous plate.

15. A stencil printing drum according to claim 1, wherein a portion of said ink non-passage strip which confronts with said ink passage region forms an angle with said ink passage region which is other than an obtuse angle.

16. A stencil printing drum according to claim 1, wherein said ink non-passage strip is formed of a continuous plate.

17. A stencil printing drum comprising:

a rotary cylindrical drum including an ink non-passage region, an ink passage region surrounded by said ink non-passage region, and an axis around which said rotary cylindrical drum rotates, said ink passage region including a start end portion at one end thereof and a finish end portion at an opposite end thereof as viewed in the direction of said rotation; and an ink supplying roller having an axis of rotation which is in parallel with said axis of said rotary cylindrical drum, said ink supplying roller being brought into contact with an inner cylindrical surface of said rotary cylindrical drum to push a printing ink out of said rotary cylindrical drum through said ink passage region, wherein said ink non-passage region protrudes radially inwardly of said rotary cylindrical drum except the start end portion thereof.

* * * * *